United States Patent [19]

Di Santo et al.

[11] Patent Number: 4,947,159

[45] Date of Patent: Aug. 7, 1990

[54] POWER SUPPLY APPARATUS CAPABLE OF MULTI-MODE OPERATION FOR AN ELECTROPHORETIC DISPLAY PANEL

[75] Inventors: Frank J. Di Santo, North Hills; Denis A. Krusos, Lloyd Harbor, both of N.Y.

[73] Assignee: 501 CopyTele, Inc., Huntington Station, N.Y.

[21] Appl. No.: 182,436

[22] Filed: Apr. 18, 1988

[51] Int. Cl.[5] ..... G09G 3/00

[52] U.S. Cl. ..... 340/787; 350/362; 340/805

[58] Field of Search ..... 340/787, 788, 805; 350/362

[56] References Cited

U.S. PATENT DOCUMENTS

| | | | |
|---|---|---|---|
| 4,203,106 | 5/1980 | Dalisa et al. | 350/362 |
| 4,420,749 | 12/1983 | Koyanagi et al. | 340/785 |
| 4,485,379 | 11/1984 | Kinoshita et al. | 340/781 |
| 4,655,897 | 4/1987 | Di Santo et al. | 350/362 |
| 4,746,917 | 5/1988 | Di Santo et al. | 342/787 |

*Primary Examiner*—Alvin Oberley
*Attorney, Agent, or Firm*—Arthur L. Plevy

[57] ABSTRACT

There is disclosed a multi-mode power supply for biasing an electrophoretic display and particularly for biasing the anode electrode of such a display. The supply contains first and second supply means each of which can operate as a constant voltage or constant current supply. The first and second supplies are respectively coupled to the anode electrode of the electrophoretic display so that during the Write Mode the display is operated with a constant current at a first polarity and operates with a constant current at a second polarity during the Erase Mode. Additional modes are shown where AC voltages are applied to the anode electrode either directly as in the case of a Slow Erase Mode or via a capacitor in the case of a Time 60 Cycle Mode for a given time period. In these modes the supplies are operated as constant voltage sources to enable suitable magnitude voltages to be applied to the anode electrode in order to provide optimum operating conditions for the electrophoretic display.

17 Claims, 3 Drawing Sheets

- HV CONSTANT
I OR V CONTROL
CIRCUIT 41
INPUT -10
74LS06
80
+5
1M4001
82
81
+12V
84
83
MC4741
(1)
91
200K
V6
V5
39K
85
MC4741
(1)
92
+12 -12
51K
93
400K
.01
MC4741
(2)
100
100K
V3
102
2N3904
+12V
103
2N3904
+12V
MC-5
INPUT
43
+HV
90
+12
120
360
IN751A
101
V4
+5V
+12V
100
96
IN758A
95
+10V
10K
94

POWER SUPPLY APPARATUS CAPABLE OF MULTI-MODE OPERATION FOR AN ELECTROPHORETIC DISPLAY PANEL

BACKGROUND OF INVENTION

This invention relates to electrophoretic displays in general and more particularly to a power supply for properly biasing and maintaining reliable operation of such a display.

The prior art is replete with many references which relate to electrophoretic displays. Reference is made to U.S. Pat. No. 4,655,897 issued on Apr. 7, 1987 to Frank J. DiSanto and Denis A. Krusos, the inventors herein, and assigned to Copytele, Inc., the assignee herein. Essentially, that patent discloses an electrophoretic display apparatus which includes a planar transparent member having disposed on the surface a plurality of vertical conductive lines to form a grid of lines in the Y direction. On top of the grid of vertical lines there is disposed a plurality of horizontal lines in the X direction which are positioned above the vertical lines and insulated therefrom by a thin insulating layer at each of the intersection points.

Spaced above the horizontal and vertical lines patterns is a conductive anode plate. The space between the conductive plate and the X and Y line patterns is filled with an electrophoretic suspension containing chargeable pigment particles. When a voltage is impressed between the X and Y lines, pigment particles which are located in wells or depressions between the X and Y pattern are caused to migrate toward the conductive plate and are deposited in accordance with the bias and drive signals supplied to the X and Y line conductors.

The patent also describes the operation and fabrication of such displays. In any event, there are many other references which pertain to electrophoretic displays.

Basically, as indicated above, the electrophoretic display consists of a suspension of pigment particles dispersed in a dye solvent of contrasting color. The solvent as well as the particles is placed into a cell which basically consists of two parallel and transparent conducting electrodes designated as the anode and cathode. Many such cells in the prior art also employ a grid electrode which further controls the transportation of charged particles. See the above-cited patent for an examples of this type of display.

In operation the charged particles are transported and forced against one electrode as the anode or cathode under the influence of an applied electric field so that the viewer may see a desired pattern formed by pigment particles. When the polarity of the field is reversed, the pigment particles are transported and packed on the opposite electrode. As indicated, the prior art is cognizant of such devices.

A particularly interesting application which is co-pending herewith is entitled METHOD AND APPARATUS FOR OPERATING AN ELECTROPHORETIC DISPLAY BETWEEN A DISPLAY AND A NON-DISPLAY MODE, filed on July 14, 1986, Ser. No. 885,538, U.S. Pat. No. 4,746,917, for Frank J. DiSanto and Denis A. Krusos, the inventors herein, and assigned to the assignee, Copytele, Inc.

In that application there is shown an electrophoretic display which is operated in a first mode where the display operates to display data and has normal DC voltages applied to its electrodes. During a second mode or a non-display, mode a suitable alternating voltage of a given frequency and magnitude is AC coupled to the anode electrode of the display for a predetermined time interval to cause pigment particles to settle between the anode and cathode whereby the effective life of said display is increased. The transfer of the display mode to the second mode is afforded by suitable switching circuitry.

That application describes the biasing of the various electrodes of the electrophoretic display and particularly describes operation during a non-display mode and a display mode.

As seen in that application, there is shown the various electrodes associated with the electrophoretic display and the biasing of the electrodes in the first and second modes. The patent application shows various relays which are utilized to power the display during the operational mode and to remove power from the display during a non-operating mode.

The electrophoretic display has a particular advantage in that once data is written into the display, the data can remain displayed for extended periods of time without the utilization of any biasing potential.

The electrophoretic display operates in many modes. One mode is the Write Mode. In the Write Mode the anode voltage is positive to allow pigment particles to migrate to the anode under control of signals applied to the grid and cathode. During an Erase Mode, particles which migrated to the anode are removed from the anode thus erasing the display. In the Erase Mode the anode is negative. There is also a Hold Mode. During the Hold Mode, the anode voltage is positive and essentially the Hold Mode is similar to the Write Mode in that the anode is positive and is awaiting the receipt of data. As one will understand, the electrophoretic display is changed during operation from the Hold or Write Mode to the Erase Mode to thereby erase data and then write data back into the display.

This is a typical operation. In order to perform such operations, the anode voltage, as will be explained, is switched between a positive and a negative level indicative of the Write or Hold Mode as compared to the Erase Mode. There are other modes which are associated with the electrophoretic display one of which is indicated in the above-referenced co-pending application. In these modes the anode electrode is supplied with suitable AC operating potentials either coupled to the anode electrode via a capacitor or directly applied to the anode electrode at relatively slow rates. The technique of applying an AC signal to the anode is described in regard to the above-noted co-pending application to prevent agglomeration clustering.

The electrophoretic display has been analogized in operation to that of a vacuum tube triode. Hence, the various electrodes for such a display have been designated as the anode, the grid and the cathode. While the analogy has some basis in regard to understanding operation of the display, an electrophoretic display is subjected to many variations which are not provided in a typical vacuum tube triode. As noted, the electrophoretic display is associated with a suspension of pigment particles dispersed in a dye solvent of contrasting color. This affords the medium through which the particles are directed to the anode or cathode of the display. Due to this medium, the characteristics of the display vary greatly. These variations depend upon the recent history of the display such as when it was last operated and in what mode. Certain of the characteristics of the display depend on the operating temperature as well as how long the display was inactive. Most of these phenomenon are due to the chemical nature of the suspension as well as the characteristics of the solvent and pigment particles.

In particular it is indicated that when the anode electrode of such a display is switched to the Erase Mode or the Hold Mode, the anode current peaks to a value as high as four times the steady state current then falls to a value somewhat below the steady state current and finally settles to the steady state current. In the case of switching the anode to the Hold Mode the high peak current decreases the amount of pigment left in the wells of the display and thereby decreases the brightness of the display. In addition, since the initial data applied to the panel drives all the grids positive and the anode current is higher than steady state at this time, a larger amount of pigment is moved from the wells than would normally be the case if the anode current were at steady state.

The brightness of the panel is therefore reduced. Furthermore, as indicated above, the anode current as a function of anode voltage is dependent upon the recent history of the panel such as when it was last operated and in what mode. In addition, the dip in anode current, below steady state, may cause the initial portion of the image to be lighter than the remaining image which is written when the anode current has reached steady state. Thus, as one can ascertain from the above, the effective impedance of the electrophoretic display varies as a function of these different conditions. This impedance variation of the display effects the display brightness.

It has been found that by utilizing a constant current supply to drive the anode of such a display, many of the above-noted problems are avoided.

It is an object of the present invention to provide optimum operation of electrophoretic displays by biasing the anode of the display with a constant current source.

It is a further object of the present invention to provide an electrophoretic display which is capable of displaying a uniform bright image by biasing said display with a constant current source during the Hold, Write and Erase Modes.

BRIEF DESCRIPTION OF THE PREFERRED EMBODIMENT

In an electrophoretic display of the type having an anode electrode associated with an X-Y matrix manifesting grid and cathode electrodes to provide a display by causing pigment particles to be transported to said anode electrode during a Write Mode according to drive signals applied between said grid and cathode electrodes, the improvement therewith comprising constant current source means coupled to said anode electrode to provide a constant current to said anode electrode during said Write Mode of a polarity necessary to transport said particles to said anode electrode.

DETAILED DESCRIPTION OF THE FIGURES

Figure 1:
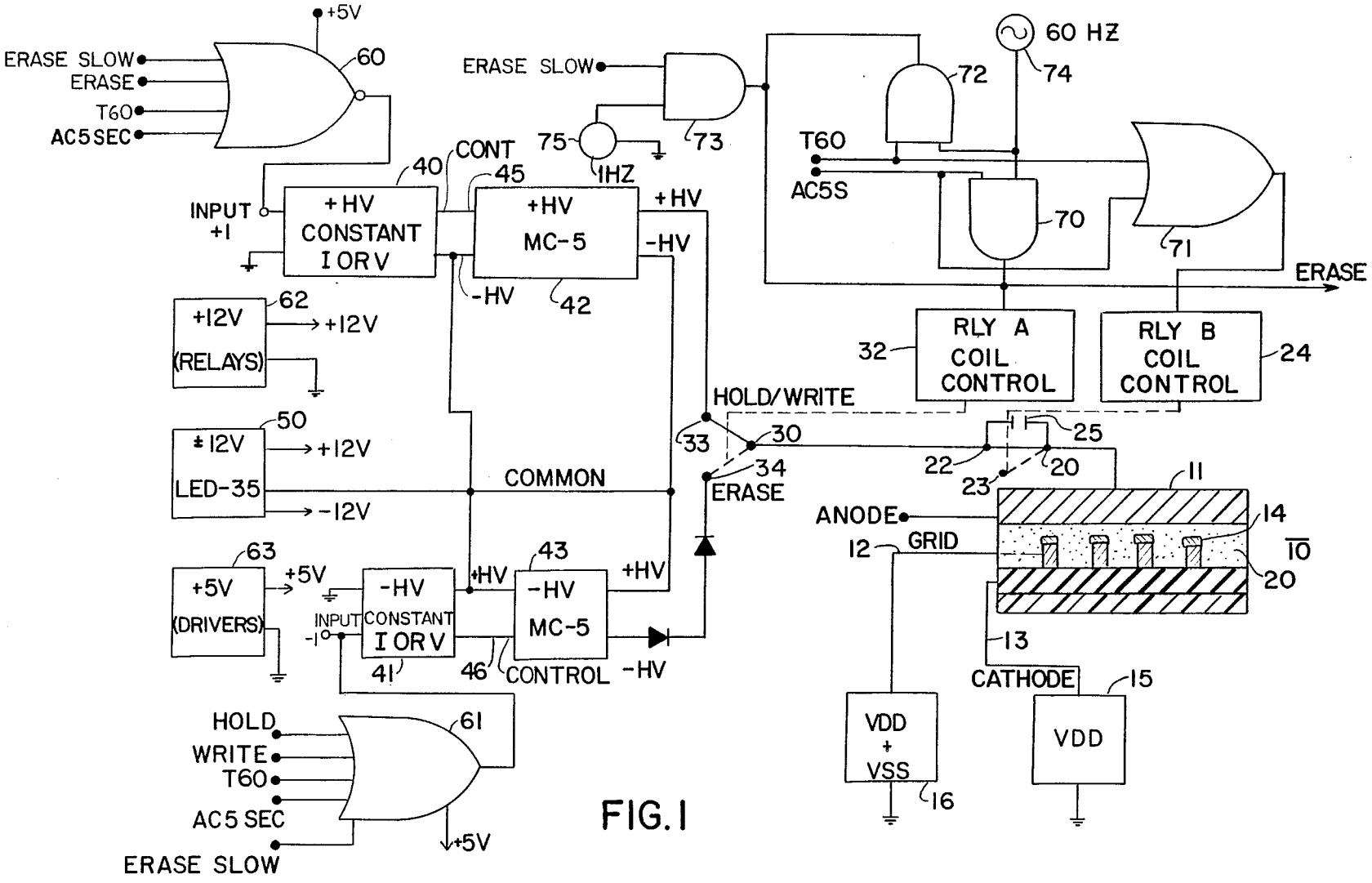
FIG. 1 is a detailed block diagram showing a multimode power supply operating in conjunction with an electrophoretic display panel.

Referring to FIG. 1, there is shown in diagrammatic view an electrophoretic display panel 10. Electrophoretic panels such as panel 10 as indicated above are fairly well known. Such panels include a suspension of colored charged pigment particles which are usually suspended in a dye solvent of contrasting color generally indicated by reference numeral 20. The charged particles are transported and packed against one electrode under the influence of an electric field to produce a desired pattern. This occurs during a Write Mode. Operation of electrophoretic panels as 10 can be compared to the operation of a vacuum tube triode. Hence, such panels include an anode electrode 11, a cathode electrode 13 and a grid electrode 12. The grid electrode allows for the selective transfer of pigment particles between the anode and cathode. The display is biased by a suitable electric field applied between the anode electrode 11 and the cathode electrode 13.

As is indicated, the electrodes as the anode, cathode and the grid are normally maintained at suitable DC biases during the Write Mode of the electrophoretic panel 10. These biases are supplied respectively by suitable biasing supplies such as supply 15 for the cathode electrode and supply 16 for the grid electrodes. Both supplies 15 and 16 are referenced to actual ground. The cathode and grid electrodes are further associated with driver circuits such as amplifiers and gates which are biased from the supplies 15 and 16 and which have suitable drive signals applied to their inputs for display writing according to those signals. The anode, as indicated, is coupled to the power supply of the present invention and which supply floats with respect to actual circuit ground.

In the Hold Mode the cathode electrode 13 is positive with respect to the grid electrode. The operation of such displays is specified in the above-noted co-pending application.

As will be explained, the anode electrode 11 is capable of being operated in many modes to satisfy the various conditions associated with electrophoretic displays. It is the main object of the present invention to drive the anode electrode with a constant current during the Hold, Write and the Erase Modes to thereby assure that the amount of current which flows through the anode is relatively constant. In this manner, the prior art problems of electrophoretic displays as indicated above are circumvented.

Before proceeding with an explanation of the operation of FIG. 1, the following descriptions are deemed to be necessary in fully understanding the invention.

As indicated, an electrophoretic display 10 is capable of operating in many modes which modes are implemented by means of suitable logic circuitry which logic circuitry exists in order to write into the display, erase the display and to further control operation of the display. In the so-called Write Mode, the anode electrode 11 has applied thereto a positive voltage to enable particles to migrate to the anode as controlled by the bias applied between the grid and cathode electrodes.

A second mode is indicated as a Hold Mode. In this mode the anode is also positive. The Hold Mode basically is defined as that mode whereby the display is waiting to receive data, and hence the Hold Mode is implemented prior to a Write Mode and may also be considered to be part of the Write Mode as a Hold/-Write Mode.

A third mode is the Erase Mode whereby the anode 11 has a negative potential applied thereto to enable particles which have been received by the anode to be removed from the anode. In the Erase Mode the anode 11 is negative with respect to the other electrodes.

As will be further explained, there are additional modes to which the anode is subjected to. One mode is a Timed 60 Cycle Mode. This is designated in FIG. 1 as T60. In this mode a 60 HZ signal is applied to the anode electrode via a capacitor. The application of 60 cycles via the capacitor serves to rejuvenate the display during periods of non-use. Hence, one can apply a 60 cycle signal of a suitable amplitude during the T60 Mode to prevent certain of the problems as described above in the co-pending application.

An AC 5-Second Mode (AC 5-S) occurs before the Write Mode. In this mode a 60 cycle AC signal is applied to the anode electrode 11 via a capacitor for a suitable period before the Hold Mode or Write Mode is entered into. The AC signal applied for a suitable interval, such as 5 seconds, which causes the charged particles to be properly suspended in the solvent between the cathode and anode. This signal operates to prevent the same problems as the T60 signal, namely, to prevent agglomeration and clustering.

There is also an Erase Slow Mode which will be explained. In the Erase Slow Mode the anode electrode 11 is switched between a negative and positive voltage which is applied to the anode electrode 11 directly and not through a capacitor as employed during the T60 and AC 5S Modes. This mode has not been previously described.

Again referring to FIG. 1, there is shown the anode electrode 11 coupled to a common terminal 20 of a relay contact 21. The relay contact 21 is associated with an output terminal 22 and another terminal 23. Relay contact 21 is controlled by a relay coil 24 which is indicated as the B-coil. As seen in FIG. 1, contacts 20 and 22 are shunted by a capacitor 25. When the relay B-coil 54 is operated, contact 21 moves from terminal 22 to terminal 23 thus placing the capacitor 25 in series with the anode electrode 11. Terminal 22 as seen is coupled to a common terminal 30 of contact 31.

Contact 31 is associated with a relay A-coil 32. Contact 31 as shown in the Figure is in contact with terminal 33, and when the relay A is operated, contact 31 contacts terminal 34. In this manner, the relay coil 32 controls operation between the Hold/Write Mode and the Erase Mode. There is shown two high voltage constant current and constant voltage control circuits 40 and 41. Each control circuit 40 and 41 is identical in circuit configuration. As will be explained, each control circuit is capable of providing in conjunction with a high voltage power supply as 42 and 43 either a constant output voltage or a constant output current which is directed to the electrophoretic display's anode 11 according to the mode of operation.

Each of the high voltage supplies designated as +HV and −HV are conventional supplies available from many manufacturers. Such high voltage supplies for example operate as follows. They have a control input as inputs 45 and 46 which control input receives an operating potential and depending upon the magnitude of the operating potential will provide a high voltage output of a suitable magnitude. Typical supplies for example will provide about 45 volts output for a one volt input. Such supplies as 42 and 43 are available from many manufacturers including a company called Gamma High Voltage Research Inc. of 30 North MacQuesten Parkway, Mt. Vernon, N.Y.

The high voltage supplies 42 and 43 as well as the control circuits 40 and 41 have a common return designated as −HV and +HV which is coupled to a common return of a floating power supply 50. The power supply 50 provides a +12 volt and −12 volt output which outputs are utilized to bias operational amplifiers in the control circuits. Each of the control circuits as 40 and 41 have a control (+1 and −1) input which is associated with a relay in each control circuit. The relay associated with each control circuit as 40 and 41 is operated during the various modes to thereby enable the desired bias to be applied to the anode electrode 11 of the electrophoretic display 10.

This bias may be a positive voltage, a negative voltage or an alternating voltage which is AC coupled via the capacitor 25 or an alternating voltage which is direct coupled. Both control circuits as 40 and 41 control the respective high voltage modules 42 and 43. Module 42 provides a given magnitude positive high voltage as controlled. Module 43 provides a given magnitude negative high voltage as controlled by circuit 41. Each control circuit as 40 and 41 operates to control the respective power supply as 42 and 43 in a constant current or constant Voltage Mode depending on the operation of the relay associated with each circuit.

As can be seen in FIG. 1, the +HV control 40 is associated with a input OR gate 60. The input OR gate 60 serves to operate a driver and an associated relay associated with the circuit 40. The OR gate 60 which essentially is a standard gate has the inputs, Erase Slow, Erase, T60 and AC 5S. During any of the above conditions, the relay associated with the control supply 40 is operated. In a similar manner, the control supply 41 has an OR gate 61 associated therewith which OR gate has the inputs indicated as Hold, Write, T60, AC 5S and Erase Slow associated therewith.

The relay associated with the control supply 41 is operated when any of the inputs to OR gate 61 go high. As seen, there are two additional power supplies designated as 62 and 63. Supply 62 is a +12 volt supply having a normal ground return while supply 63 is a +5 volt supply having a normal ground return. The supply 63 is utilized as a biasing source for the OR gates 60 and 61 while the additional supplies are utilized for operation of the control circuits 40 and 41. It is understood that the common return for the control circuits 40 and 41 and the high voltage supplies 42 and 43 are directed to the common return of supply 50. Hence, all the above-noted modules float with respect to actual ground.

As will be explained, the nature of the common return associated with the control circuits 40 and 41 and the high voltage power supplies 42 and 43 enable the anode current of the electrophoretic display to be sensed by suitable resistors associated with the control circuits 40 and 41. In this manner, the control circuits control the associated power supplies 42 and 43 so that they can be operated in a constant current mode where the associated resistors sample the total anode current or can be operated in a constant voltage mode during other operating modes associated with the electrophoretic display.

As one can further determine from FIG. 1, both the relay coils 32 and 24 are associated with a plurality of gates. These gates are AND or OR gates and essentially are shown in FIG. 1 in their functional relationship. It is, of course, understood that many different configurations can be employed for the gates such as the use of suitable relay contacts or other logic circuitry to implement the gating functions as shown in FIG. 1. During the T60 mode as well as the AC 5S Mode, both relay coils 24 and 32 are operated. Relay coil 24 is operated via OR gate 71 whereby contact 21 moves to the dashed line position, and hence capacitor 25 is in series with the anode electrode 11 of the electrophoretic display. In both these modes relay coil 32 is operated so that a suitable 60 cycle signal is applied via gate 70 which 60 cycle signal is derived from an oscillator or other source 74. In this manner during both the AC 5S and T60 Modes, AND gate 70 and 72 serve to operate relay coil 32 at the 60 cycle rate thereby switching contact 31 between terminals 33 and 34. During this mode, as will be explained, both the high voltage generators 42 and 43 as controlled by the control circuits 40 and 41 operate in a constant voltage mode.

Hence in the T60 and AC 5S Modes the contact 31 associated with relay A or coil 32 operates at a 60 cycle rate to apply a 60 cycle signal via capacitor 25 to the anode electrode of the display. During the Erase Slow Mode as indicated by gate 73, a low frequency signal such as one to three cycles obtained via generator 75 is applied to the anode. It is seen that during the Erase Slow Mode, the relay coil B or coil 24 is not operated. Hence, the low frequency signal indicative of the switching rate applied to relay coil 32 is applied directly to the anode electrode 11 of the display. This causes the anode electrode to switch from a positive high voltage to a negative high voltage at a one cycle or other low frequency interval. This provides a slow erasing of the display or removes particles from the display in a controlled manner to further assure that the display operates correctly and that prior art problems as agglomeration and clustering do not occur.

It is thus seen briefly from the above that the display is capable of operating with different voltages applied to the anode electrode 11 during different modes of operation which are necessary to enable proper and efficient operation of the display as will be further explained.

Figure 2:
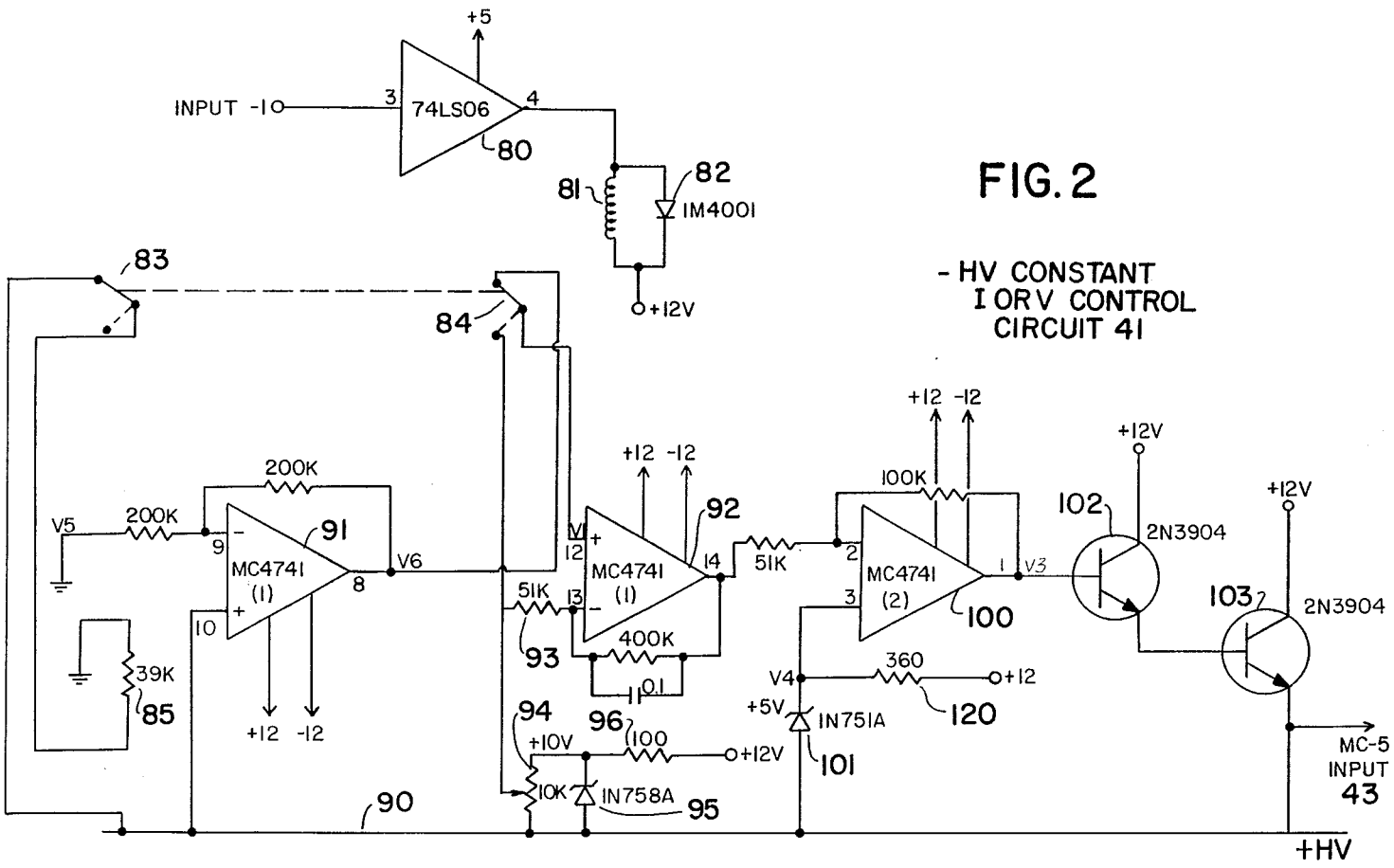
FIG. 2 is a schematic diagram showing a first control circuit schematic for use with the invention to enable the power supply to be operated in a constant current or constant voltage mode.
Figure 3:
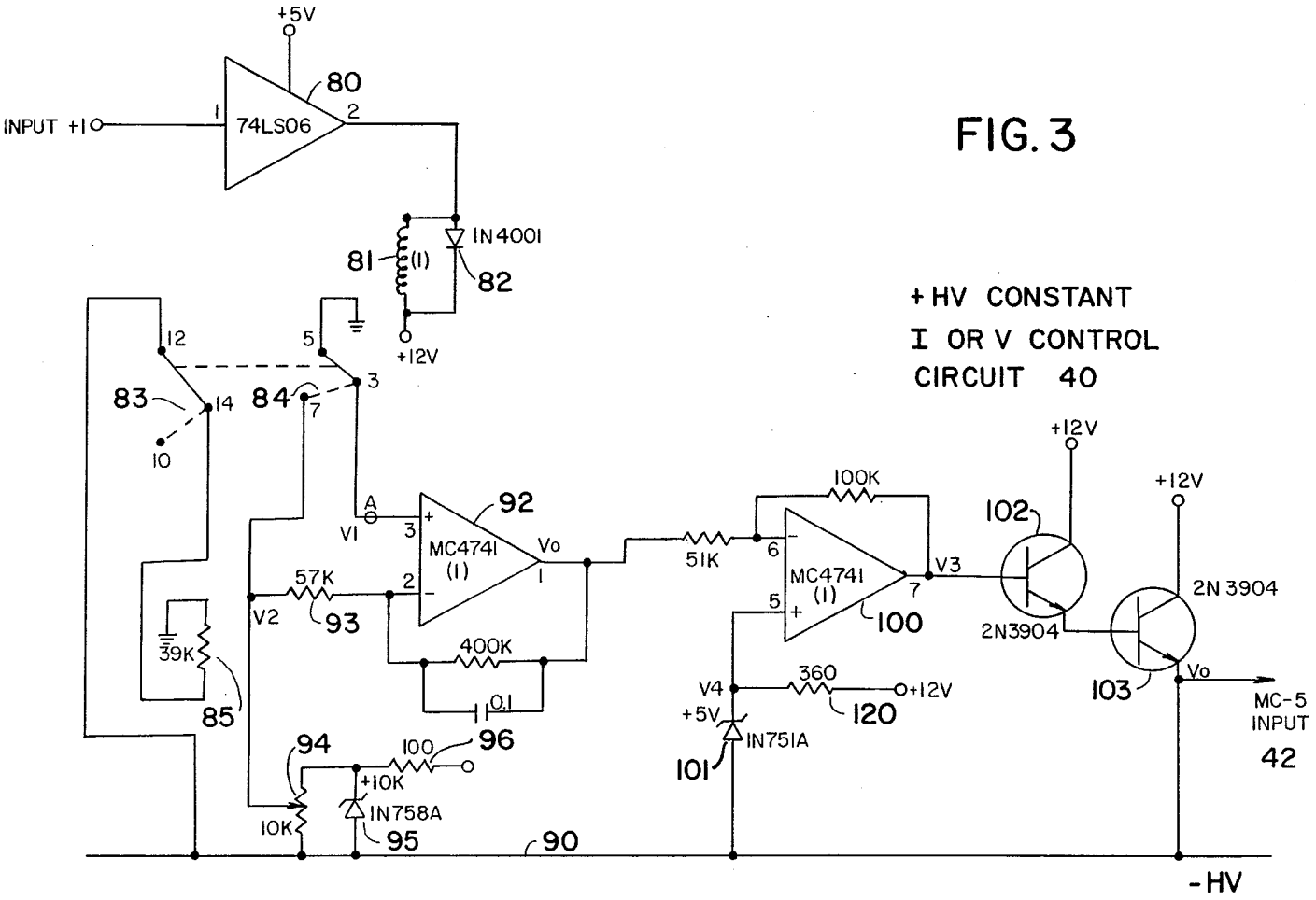
FIG. 3 is a schematic diagram showing a second control circuit schematic used in this invention.

Referring to FIG. 2, there is shown a circuit diagram of the −HV constant control circuit 41. FIG. 3 shows the circuit diagram for the +HV control circuit 40. At the onset, it is understood that circuits 40 and 41 employ many identical components but as explained are operative during different modes of the electrophoretic display operation. The circuit of FIG. 2 differs from the circuit of FIG. 3 in that there is included in FIG. 2 an additional amplifier 91 which is an inverting amplifier. This amplifier 91 is omitted in the circuit of FIG. 3. The purpose of amplifier 91 in the control circuit 41 is to account for the reverse current flow through resistor 85 for the −HV control circuit operation. The circuits control the +HV supply 42 in the case of control circuit 40 and the −HV supply 43 in the case of the control circuit 41. It is expressly understood that both the +HV supply 42 and the −HV supply 43 have input and output commons and an input electrode for control and an output electrode for developing the respective high voltages. The commons of both supplies are wired as shown in FIG. 1 and all are returned to a common floating ground.

Referring again to FIG. 2 and FIG. 3, there is shown an input driver 80 which is associated with a relay coil 81. The relay coil 81 selectively operates contacts 83 and 84. The input driver 80 receives the output of gate 60 in the case of the +HV constant control circuit 40 or receives the input from gate 61 in the case of the −HV constant control circuit 41. In this manner, the relay coil 81 when energized switches the contacts 83 and 84 from the position shown in FIG. 2 and FIG. 3 to the dashed line positions. As seen in FIG. 2 and FIG. 3, there is a resistor 85. The resistor 85 has one terminal connected to the common return 90 which terminal is directed to the contact 83. The other terminal of resistor 85 is connected to actual circuit ground. Thus as shown in the Figure, when the relay coil 81 is not energized by the driver 80, the resistor 85 appears from the common lead 90 to ground. Thus, the resistor 85 senses the total anode current of the supply due to the floating ground arrangement.

This current which flows through resistor 85 produces a voltage at the ground lead of resistor 85 relative to lead 90. This voltage is sensed by means of the amplifier 91 for the −HV control circuit 41 which provides an output voltage according to the amount of current flowing through resistor 85. In the case of FIG. 3, the voltage across resistor 85 is secured by amplifier 92 which provides an output voltage according to the current flow through resistor 85. Hence the output voltage designated as V6 at the output of amplifier 91 varies according to the current flowing through resistor 85 for circuit 41. The output of amplifier 91 is directed through contact 84 where it goes to one input V1 of the amplifier 92. The other input of amplifier 92 goes to a resistor 93 which has one terminal coupled to a potentiometer 94 in parallel with a Zener diode 95 and receives operating potential from the +12 volt supply through resistor 96. The +12 volt supply is taken from supply 50 which as shown in FIG. 1 has a common lead connected to the common terminal 90 of both the control circuit 40 and 41.

In a similar manner, the amplifiers as 91 and 92 are biased from the supply 50 to enable them to exhibit both positive and negative output voltages. In any event, the amplifier 92 provides an output voltage proportional to the voltage at its two input terminals. The voltage from the output of amplifier 91 is designated as V1. The amplifier 91 will produce an output voltage which basically is proportional to −V5. This output voltage is strictly dependent upon the magnitude of the resistances associated with the amplifier. The output of amplifier 92 is also a function of the current flowing through resistor 85 as is the case of both FIGS. 2 and 3. The output of amplifier 92 is directed to one input of an amplifier 100. The other input of amplifier 100 is coupled to a reference Zener diode 101 which is biased through a resistor 120 and coupled to the 12 volt supply terminal of supply 50. The output of amplifier 100 is coupled to the base electrode of a first transistor 102 having its emitter electrode coupled to the base electrode of a second transistor 103. The emitter electrode of transistor 103 is connected directly to the control electrode of the respective supplies 42 and 43.

Hence for the +HV control 40 the emitter electrode of transistor 103 is coupled to control electrode 45. For the −HV control circuit 41 the emitter electrode of transistor 103 in that circuit is coupled to the control electrode 46. It is understood that the common terminal as 90 for both the circuit 40 and 41 is coupled to the commons of each high voltage supplies as 42 and 43 and is also coupled to the common of the floating supply 50.

As can be seen from the above, the operation of the circuit essentially has been described for the relay coil 81 not being energized and therefore the contacts 83 and 84 of the relay coil 81 are shown in the closed position. It is understood that when the driver 80 energizes the respective coil 81, the contacts 83 and 84 move to the dashed line position. As will be further explained, when the contacts are in the position as shown in FIG. 2 and FIG. 3, the control circuits 40 and 41 operate as to provide a constant current output via the high voltage generators 42 and 43. This constant current output is provided as the circuit monitors the current flowing through resistor 85 and produces a control voltage to the high voltage supply according to the voltage provided across resistor 85 as due to the current flowing through the anode 11 of the display.

As one can see, when the relay coil 81 is energized via amplifier 80, contacts 83 and 84 are placed in the dashed line position. As seen in the dashed line position, resistor 85 is no longer in circuit and the output of amplifier 91 is disconnected from the input V1 of amplifier 92. When the relay coil is operated as indicated above, the input V1 of amplifier 92 is connected to the terminal V2 of the voltage divider including resistor 93 and potentiometer 94. Hence, when the relay coil operates the contacts 83 and 84 to the dashed line position, the output of amplifier 92 produces a constant voltage as does the output of amplifier 100 which causes the emitter electrode of transistor 103 to also provide a constant voltage and hence causing the high voltage supply 42 and the high voltage supply 43 to produce a constant voltage during the operation of the respective relays in circuits 40 and 41.

Thus it is clear that both the control circuits 40 and 41 utilize a similar circuit configuration as shown in FIG. 2 and FIG. 3. The following operations will now be explained in regard to the above-noted operating modes of the electrophoretic display 11.

THE HOLD/WRITE MODE

As indicated and by referring to FIG. 1, contact 31 of relay coil 32 is in contact with terminal 33. Relay coil 24 is not operated and hence capacitor 25 is shorted out. During this mode which is the Hold/Write Mode, the driver 80 of circuit 40 is not operated by means of the OR gate 60. In this case the contacts 83 and 84 associated with the control circuit 40 are in the position shown in FIG. 2. Thus the output of transistor 103 causes the +HV supply 42 to provide a varying output voltage or to provide a constant current due to the fact that resistor 85 associated with control circuit 40 is monitoring the current through the anode electrode 11 of the electrophoretic display. In this Hold/Write Mode the gate 80 associated with control circuit 41 operates as indicated via the OR gate 61. Hence during this condition, the control circuit 41 has the contacts 83 and 84 in the dashed line position and essentially the output from the supply 43 is a constant voltage which is coupled to terminal 34 of relay contact 31 and which as indicated in FIG. 1 is not in any manner applied to electrode 11. It is immediately understood that the activation of the coil 81 during the Hold/Write Mode is completely necessary to remove resistor 85 from the common lead 90 so that the total current is only monitored by the resistor 85 associated with the control circuit 40 and not also by control circuit 41.

THE ERASE MODE

As indicated again in FIG. 1, during the Erase Mode, relay coil 32 is operated where contact 31 goes from the position shown in FIG. 1 to the dashed line position. In the dashed line position contact 31 contacts terminal 34. Again, in the Erase Mode the relay coil B or 24 is not operated and hence terminal 34 is directly coupled to the anode electrode 11 of the electrophoretic display. During the Erase Mode, the driver 80 associated with the control circuit 40 is operated. Hence, during the Erase Mode, the contacts 83 and 84 associated with control circuit 40 are moved to the dashed line position thus removing the resistor 85 and removing the output of amplifier 91 for control circuit 40.

As again seen in FIG. 1, during the Erase Mode, the relay coil 81 associated with the control circuit 41 is not operated. Hence the control circuit 41 operates to supply a varying voltage to the high voltage supply 43 to operate that supply in a constant current mode. It is again noted that a constant current will be applied to the anode electrode 11 of the electrophoretic display which constant current is provided by the same operation as the current supplied during the above described Hold/-Write Modes.

It is noted that in this mode the output from the high voltage supply 42 is not applied in any manner to the anode electrode of the electrophoretic display. It is of course understood as explained that the Hold/Write Mode as indicated above can be implemented as a two-stage operation or be a single mode as the biasing and operation of the electrophoretic display for the Hold and Write Modes is identical. As one can understand, during Erase, Write or Hold, the electrophoretic display receives a constant current during each of the modes as afforded by the control circuit 40 or 41 as coupled to the respective high voltage supplies 42 and 43. This constant current eliminates the problems described in the Background of the Invention and assures that the display will exhibit uniform brightness when being operated between the Hold, Write and Erase Modes.

ERASE SLOW MODE

As one can immediately ascertain, during the Erase Slow Mode, both gates 60 and 61 are operated. In this manner both drivers 80 in each control circuit as 40 and 41 operate the respective coils 81 to place the contacts in the dashed line position. Hence in the Erase Slow Mode both supplies are constant voltage supplies as controlled by the control circuits 40 and 41. In the Erase Slow Mode as indicated above, gate 73 is operated allowing a 1 HZ or low frequency signal via generator 75 to be applied to operate relay coil A which moves contact 31 between terminals 33 and 34 at the frequency provided by the generator 75. Relay coil B is not operated and hence the output available at terminal 30 of contact 31 is directly coupled to the electrophoretic anode electrode 11. This switches the anode 11 from a positive DC to a negative DC or provides a direct coupled signal which causes the particles which adhered to the anode electrode to migrate back into the solution. Since the switching rate is very slow, the operation provides a slow erase which operates to rejuvenate the display without the use of the series capacitor 25.

THE T60 MODE

Again, in the T60 Mode both gates 60 and 61 of FIG. 1 are high causing the contacts 83 and 84 of the control circuits 40 and 41 to be in the dashed line position causing both supplies 42 and 43 to operate as constant voltage supplies. As was explained, during the T60 Mode, the output of AND gate 72 applies a 60 cycle signal from generator 74 which signal operates the relay coil 32 at a 60 cycle rate.

Relay coil B or coil 24 is operated via gate 71 to thereby couple the output voltage at terminal 30 of contact 31 to the anode electrode 11 via the capacitor 75. It is of course understood that during the T60 Mode, the contact 31 moves at a 60 cycle rate between terminals 33 and 34 and both supplies 42 and 43 operate at a constant voltage which voltages are AC coupled via capacitor 25 to the electrode 11 of the display at the 60 HZ rate.

THE AC 5 MODE

During this mode, both gates 60 and 61 are operated to thereby move the contacts 83 and 84 to the dashed line position to cause both the control circuits 40 and 41 to provide a constant voltage output via supplies 42 and 43. During this mode, relay A is operated again at a 60 cycle rate via gate 70. Relay B is also operated so that contact 21 is in position 23 allowing the 60 cycle AC signal be applied to the anode electrode 11 of the electrophoretic display via the capacitor 25. In this manner the signal is applied for a time period of 5 seconds or thereabouts. The operation is the same as the T60 mode with the exception that the time period is implemented for a suitable fixed period such as 5 seconds.

It is one objective to apply this signal for a duration before writing again into the display, and as indicated above, the application of such a signal for suitable time durations and a suitable frequency and amplitude is described in the above-noted copending application.

As one can see from the above, it is necessary to provide a multi-mode operating power supply apparatus in order to properly bias and operate an electrophoretic display panel. In this manner the display can be efficiently operated during the various modes as described above. It is also understood that the various modes as indicated above for example Hold, Write, Erase and so on are provided by means of additional logic circuitry which is cognizant of when the display is to receive data or be placed in the Write Mode or to have data erased as to be placed in the Erase Mode or to be placed in any of the additional above-described modes.

This operation can be afforded by means of a microprocessor or any other suitable control logic in order to operate the electrophoretic display in the above-described modes and to be assured that the control circuits 40 and 41 serve to operate the power supplies 42 and 43 in the appropriate modes as either exhibiting a constant voltage or a constant current. Both the power supplies 42 and 43 are conventional supplies and operate to produce an output voltage according to the magnitude of a control signal applied to input control electrodes 45 and 46. The typical output of each supply is about 200 to 250 volts for electrophoretic display operation. In this manner the supply 42 supplies approximately a positive 200 volt DC while supply 43 supplies approximately a negative 200 volt DC output.

As one can ascertain, the utilization of the control circuits 40 and 41 in combination with the high voltage supplies 42 and 43 as associated with the electrophoretic display enables proper and constant operation of the display. Due to the constant current modes in the Hold, Write and Erase Modes, the display provides a uniform brightness as compared to a prior art display.

There is a further need for these supplies to be operated in a constant voltage mode whereby the current sensing resistors are removed from the circuit by means of the associated relays. It is also understood that in FIG. 2 and FIG. 3 various components which have not been designated by specific reference numerals have associated therewith the actual value of the component. As for example, resistor 96 has the designation 100 which means that resistor 96 is a 100 Ohm resistor. Resistor 94 is a potentiometer which is 10,000 Ohms. The amplifiers 91, 92 and 100 are MC4741's which is an integrated circuit amplifier available from many manufacturers. In a similar manner resistor 85 is also associated with the numeral 39 K which means that it is a magnitude of 39,000 Ohms. The various voltages associated with the operational amplifiers such as +12 and −12 are obtained from supply 50. The biasing for the driver 80 is obtained from supply 63 of FIG. 1 which is referenced to actual ground. The +12 volts supply associated with relay coil 81 is obtained from supply 62 of FIG. 1.

The +12 volt supplies for transistors 102 and 103 is obtained from supply 50 which is the floating supply as is the +12 volt supply for the Zener diodes 95 and 101.

Thus in view of the above, it is indicated that the utilization of the above multi-mode operating supply avoids many of the problems as indicated in the Background of the Invention and enables an electrophoretic display to operate with a constant current in both the Hold, Write and Erase Modes. This constant current is obtained by monitoring the current through the anode electrode of the electrophoretic display by the sensing resistors 85.

It is understood that while the various relay configurations are shown as electromechanical devices it is expressly understood that solid state relays can be employed as well. In any event, such relays for example as relays 32 and 24 could be supplied by utilizing silicon controlled rectifiers. It is clear that the function of such electromechanical relays can be replaced by solid state devices.

We claim:

1. In an electrophoretic display of the type having an anode electrode associated with an X-Y matrix manifesting grid and cathode electrodes to provide a display by causing pigment particles to be transported to said anode electrode during a Write Mode according to drive signals applied between said grid and cathode electrodes, the improvement therewith comprising:

constant current source means coupled to said anode electrode to provide a constant current to said anode electrode during said Write Mode and of a given polarity necessary to transport said particles to said anode electrode.

2. The electrophoretic display according to claim 1, wherein said constant current source means being coupled to said anode electrode and operative to provide a constant current to said anode electrode of an opposite polarity sufficient to direct said particles away from said anode electrode, indicative of an Erase Mode.

3. The electrophoretic display according to claim 2, further including controllable switching means coupled to said anode electrode and capable of operating in a first mode wherein said constant current of said given polarity is applied to said anode electrode indicative of said Write Mode and operative in a second mode where said constant current of said opposite polarity is applied to said anode electrode indicative of said Erase Mode.

4. The electrophoretic display apparatus according to claim 3, wherein said constant current source means a first constant current source for providing constant current at given polarity at an output with said output coupled to said switching means, and a second constant current source for providing constant current at said opposite polarity and coupled to said switching means and, means for operating said switching means in said first and second modes wherein said first mode said current source of said given polarity is coupled to said anode electrode and wherein said second mode and current source of said opposite polarity is coupled to said anode electrode.

5. A power supply apparatus for biasing the anode electrode of an electrophoretic display panel, said electrophoretic display having an X-Y grid manifesting cathode and grid electrodes which when driven and biased enable pigment particles to be transported and packed on the anode electrode according to drive signals applied between said grid and cathode electrodes during a Write Mode when said anode electrode is biased at a first polarity and to remove said particles as packed on said anode electrode during an Erase Mode where said anode is biased at a second polarity, said power supply comprising:

switching means having an output terminal coupled to said anode electrode and operative in a first mode where said output terminal is connected to a first input terminal and in a second mode where said output terminal is coupled to a second input terminal, a first power supply means having an output coupled to said first input terminal of said switching means for providing a first polarity biasing signal for said anode electrode when said switching means is operated in said first mode, a second supply means having an output coupled to said second input terminal and operative to provide a second polarity biasing signal when said switching means is operated in said second mode, with each of said first and second supply means including separate means for monitoring the current through said anode electrode with respect to a reference level to maintain a constant output current according to said monitored current when said first or second supply means is connected to said anode electrode by said switching means, whereby when said first supply means is connected to said first input terminal said associated means for monitoring is operative to maintain a constant current from said first supply means and when said second supply means is connected to said second input terminal said associated means for monitoring is operative to maintain a constant current from said second supply means.

6. A power supply apparatus for applying operating potential to the anode electrode of an electrophoretic display panel, comprising:

a first supply means capable of being selectively operated as a constant current supply in a first mode and a constant voltage supply in a second mode, switching means coupling said anode electrode to said first supply means during a Write Mode and means for selecting said first supply means to operate as a constant current supply during said Write Mode.

7. The power supply apparatus according to claim 6, further including:

a second supply means capable of being selectively operated as a constant current supply in a first mode and a constant voltage supply in a second mode, said switching means coupling said anode electrode to said second supply means during an Erase Mode and means for selecting said second supply means to operate as a constant current supply during said Erase Mode.

8. The power supply apparatus according to claim 7, further including means coupled to said switching means for operating said switching means at a given rate, means coupled to said first and second supply means for operating said supplies as constant voltage supplies whereby the voltage outputs of said first and second supply means are respectively applied to said anode electrode at said given rate to provide a Slow Erase Mode for said panel.

9. The power supply apparatus according to claim 8, wherein said given rate is between 1 to 3 HZ.

10. The power supply apparatus according to claim 9 further including means coupled to said switching means for selectively AC coupling said switching means to said anode electrode, means coupled to said switching means for operating said switching means at another given rate, with said selector means operative to cause said first and second supply means to operate as constant voltage supply means whereby said first and second supply means are respectively applied to said anode electrode via a to provide an AC coupled signal to said anode electrode when said anode electrode is AC coupled to said first and second supply means.

11. The power supply apparatus according to claim 10 wherein said another given switching rate is approximately 60 HZ.

12. In an electrophoretic display panel of the class having an anode display electrode, at least one cathode electrode located apart from said anode electrode and directed in a given plane and at least one grid electrode insulated from said cathode electrode and positioned transverse thereto with the space between said anode, grid and cathode electrodes filled with charged pigment particles suspended in a dye solvent wherein said particles can be transported to said anode electrode according to driving potentials applied between said grid and cathode electrodes indicative of a desired pattern during a Write Mode where said anode electrode is biased at a first polarity operating level and where said particles are removed from said anode electrode during an Erase Mode where said anode electrode is biased at a second polarity operating level, the combination therewith of power supply apparatus for biasing said anode electrode during said Write and Erase Modes comprising:

constant current source means coupled to said anode electrode for providing said first polarity operating level at a constant current during said Write Mode whereby said anode current is maintained relatively constant during said Write Mode and, said constant current source means being responsive to said display being operated in said Erase Mode to provide said second polarity operating level to said anode electrode at a constant current during said Erase Mode.

13. The apparatus according to claim 12, wherein said means responsive to said display being operated in said Erase Mode includes switching means coupled to said anode and wherein said constant current source means includes a first current source applied to said anode during a first mode of said switching means indicative of said Write Mode and a second current source applied to said anode during a second mode of said switching means indicative of said Erase Mode.

14. The apparatus according to claim 12, further including means for selectively AC coupling said anode electrode to first and second voltage sources via common switching means and for operating said switching means at a given rate to selectively apply said first and second voltages to said anode electrode at said given rate.

15. The apparatus according to claim 14, including means coupled to said switching means for selectively operating said switching means at a lower given rate and including means coupled to said first and second current sources to operate said first and second current sources as first and second voltage sources to enable voltage outputs of said first and second voltage sources to be applied directly to said anode electrode at said lower given rate.

16. The apparatus according to claim 15, wherein said lower given rate is between 1–3 HZ per second.

17. The apparatus according to claim 14, wherein said given rate is approximately 60 HZ.

* * * * *